US008302798B2

(12) United States Patent
Moss

(10) Patent No.: US 8,302,798 B2
(45) Date of Patent: Nov. 6, 2012

(54) ANTI-SPILL CONTAINER

(76) Inventor: Christine K. Moss, Troy, MI (US)

( * ) Notice: Subject to any disclaimer, the term of this patent is extended or adjusted under 35 U.S.C. 154(b) by 2001 days.

(21) Appl. No.: 11/135,898

(22) Filed: May 24, 2005

(65) Prior Publication Data

US 2005/0263523 A1 Dec. 1, 2005

Related U.S. Application Data

(63) Continuation-in-part of application No. 10/227,720, filed on Aug. 26, 2002, now abandoned.

(60) Provisional application No. 60/317,161, filed on Sep. 4, 2001.

(51) Int. Cl.
*B65D 51/12* (2006.01)
*B65D 51/00* (2006.01)

(52) U.S. Cl. ..... 220/229; 220/377; 220/781

(58) Field of Classification Search ..... 220/229, 220/377, 780, 781
See application file for complete search history.

(56) References Cited

U.S. PATENT DOCUMENTS

| | | | | |
|---|---|---|---|---|
| 3,086,674 | A * | 4/1963 | Scheuerman | 220/229 |
| 3,315,402 | A | 4/1967 | Scott et al. | |
| 4,328,904 | A * | 5/1982 | Iverson | 220/229 |
| 4,329,857 | A * | 5/1982 | Kittle et al. | 220/229 |
| 4,454,944 | A * | 6/1984 | Shillington et al. | 206/366 |
| 4,502,606 | A * | 3/1985 | Shillington et al. | 215/274 |
| 4,600,112 | A * | 7/1986 | Shillington et al. | 215/274 |
| 4,884,717 | A | 12/1989 | Bussard et al. | |
| 4,997,231 | A | 3/1991 | Smith | |
| 5,024,327 | A * | 6/1991 | Shillington | 206/366 |
| 5,025,947 | A * | 6/1991 | Leone | 220/229 |
| 5,111,854 | A | 5/1992 | Begley et al. | |
| 6,039,393 | A | 3/2000 | Roh | |
| 6,202,877 | B1 * | 3/2001 | La Torre et al. | 220/254.1 |
| 6,296,004 | B1 | 10/2001 | Gordon | |
| 6,656,514 | B1 | 12/2003 | Tubbs | |
| 2002/0014491 | A1 * | 2/2002 | Duff et al. | 220/592.16 |
| 2002/0162839 | A1 * | 11/2002 | Stull et al. | 220/229 |
| 2004/0099674 | A1 * | 5/2004 | McDonough et al. | 220/714 |
| 2005/0145636 | A1 * | 7/2005 | Albright et al. | 220/714 |

* cited by examiner

*Primary Examiner* — Mickey Yu
*Assistant Examiner* — Niki Eloshway
(74) *Attorney, Agent, or Firm* — Parsons & Goltry; Robert A. Parsons; Michael W. Goltry

(57) ABSTRACT

An anti-spill food or small item container assembly having an open top and defining a chamber adapted to contain food. A lid is detachably secured to the container and the lid includes a flexible portion extending across and covering the open top of the container. The flexible portion includes at least one slit which forms at least one flap in the lid to permit access to the interior chamber of the container in which the food is contained. Furthermore, the flexible portion is constructed of a material having shape memory so that, after deflection of the flap, the flap will substantially return to its original position.

20 Claims, 2 Drawing Sheets

ANTI-SPILL CONTAINER

CROSS-REFERENCE TO RELATED APPLICATIONS

This application is a Continuation-in-part of United States patent application of the same inventor and the same title, filed 26 Aug. 2002, now abandoned bearing Ser. No. 10/227,720, which claimed the benefit of U.S. Provisional Patent Application 60/317,161 filed Sep. 4, 2001, which is incorporated herein by reference.

BACKGROUND OF THE INVENTION

I. Field of the Invention

The present invention relates generally to food or small item containers and, more particularly, to an anti-spill container for food or other small items.

II. Description of Related Art

It is well known that small infants, when learning to feed themselves, frequently spill food from containers for the food. This, of course, creates a mess of food around the infant which must be cleaned up by the caregiver.

In order to minimize the mess caused by infants spilling food from their containers, there are a number of previously known anti-spill dispensers for milk and other liquids. These anti-spill dispensers typically include a valve which closes thus containing the liquid within the interior of the container when the container is knocked over to one side or on its top.

While there have been a number of previously known anti-spill containers for liquids, only a few previously known anti-spill containers for solid food are known. Such solid foods can include, for example, cereal which is placed into a cup and given to the child. The contents, i.e. the solid food within the cup oftentimes become spilled on the floor thus requiring cleaning by the caregiver.

An example of one known snack container is described in U.S. Pat. No. 4,884,717, entitled "Non-Spilling Snack Container", issued 5 Dec. 1989. This container is constructed with a plurality of tongues that spiral inwardly to meet in the center and form a closure. Each tongue is joined with adjacent tongues by a pleated flange that folds out of sight downwardly into the receptacle. The purpose of the flanges is to eliminate the pointed tips, which might feel scratchy to a delicate skin of a hand or fingers entering the opening. However, structures similar to this are complicated and costly to manufacture.

An example of another known snack container is described in U.S. Pat. No. 6,656,514, entitled "Spill-proof Lid and Container", issued 2 Dec. 2003. Containers of this type include a lid with a plurality of resilient flaps that extend inwardly from a bottom end of a flange attached to the upper edge of the container. The flaps have convex outer surfaces defining an inner trough adjacent the flange. The flaps are preferably formed of plastic materials and rubber materials. The problems with this type of container are that normal well known plastic materials result in sharp points at the center that have a tendency to scratch the hand and to catch the hand so that it can be difficult to withdraw. If rubber is used it can either have the same result or it will be so limp it will not properly close the container. Also, rubber is opaque so that the contents of the container can not be viewed from the top.

It would be highly advantageous, therefore, to remedy the foregoing and other deficiencies inherent in the prior art.

Accordingly, it is an object of the present invention to provide a new and improved anti-spill container that can be used without scratching the hand and/or catching on the hand as the hand is withdrawn.

Another object of the invention is to provide a new and improved anti-spill container that is relatively inexpensive to manufacture.

SUMMARY OF THE PRESENT INVENTION

The present invention provides an anti-spill food container for an infant or toddler which is particularly designed to contain a solid food, such as cereal.

In brief, the food container assembly of the present invention includes a food container having an open top and defining a chamber adapted to contain a food. Preferably, the container is in the shape of a cup or similar article.

A lid is detachably secured to the container and this lid includes a flexible portion or diaphragm extending across and covering the open top of the container. The flexible portion or diaphragm of the lid is constructed of a soft, resilient plastic material and is resiliently secured to the container. In particular the material from which forms the flexible portion or diaphragm includes a material with a durometer of 65-95 and a tear strength of greater than 200 lb/in. A typical example of materials that meets these qualifications is thermoplastic polyurethane (TPU) or thermoplastic polyesters (TPE), as well as polyolefin Elastomers (POE). However, alternate constructions can be used to secure the lid to the container.

The flexible lid portion includes at least one, preferably two or more, crossing slits which form at least one flap in the lid portion. Thus, even though the flexible lid portion extends across the open top of the container, by inserting one's hand through the flap and into the interior chamber of the container, one may gain access to and remove food or other items from the container. Further, because of the unique material used in the flexible portion or diaphragm of the lid a hand inserted into the interior chamber will not be scratched by sharp points and will not be difficult to extricate. Preferably, the flexible lid portion is constructed of a transparent material.

The material from which the flexible portion or diaphragm of the lid is constructed also has shape memory. Consequently, after one inserts his or her hand through the flap and into the interior of the container, upon removal of the hand from the container the flap will return to its original position thus again covering the open top of the container. Consequently, even in the event that the container is tipped onto its side or top, the flexible lid portion still retains the solid food or items within the interior chamber of the container.

The anti-spill container of the present invention can also be used to contain other small items, such as coins, and used by adults.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
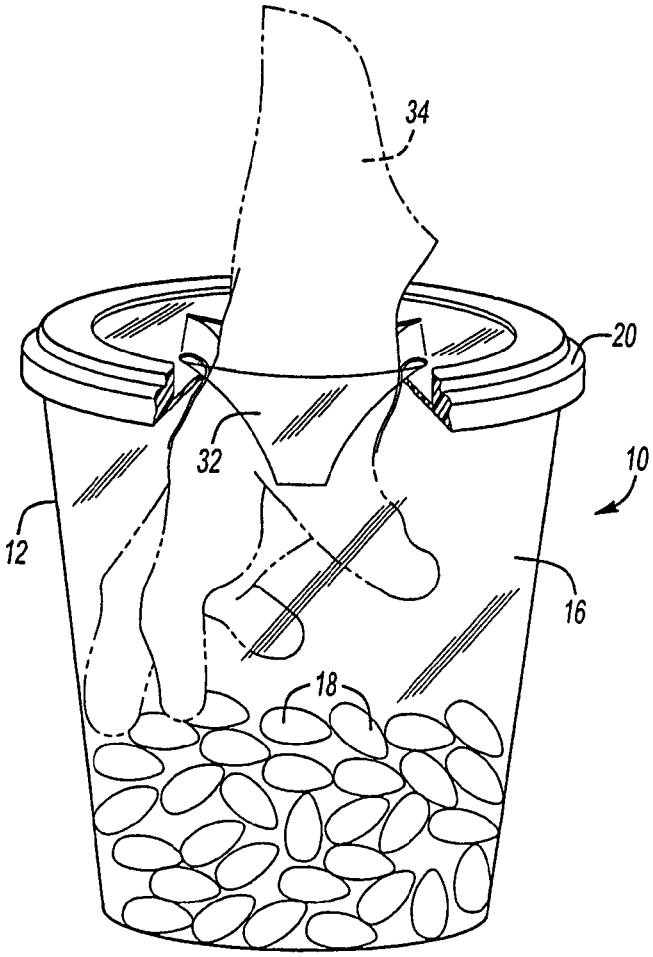
FIG. 1 is a side diagrammatic view illustrating a preferred embodiment of the present invention.
Figure 2:
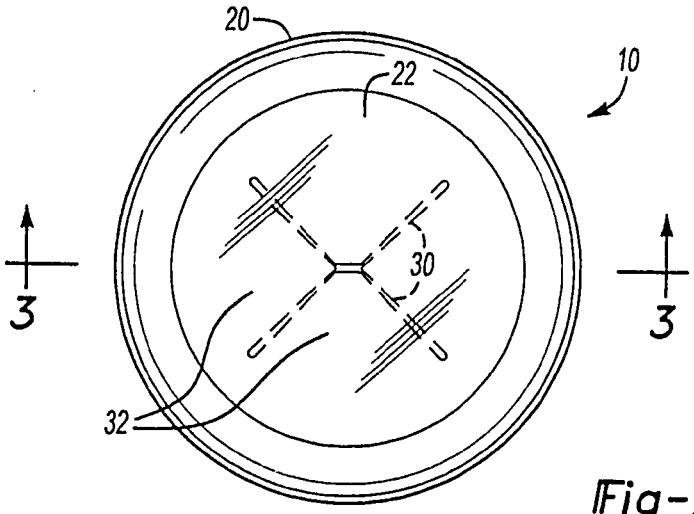
FIG. 2 is a top plan view thereof.
Figure 3:
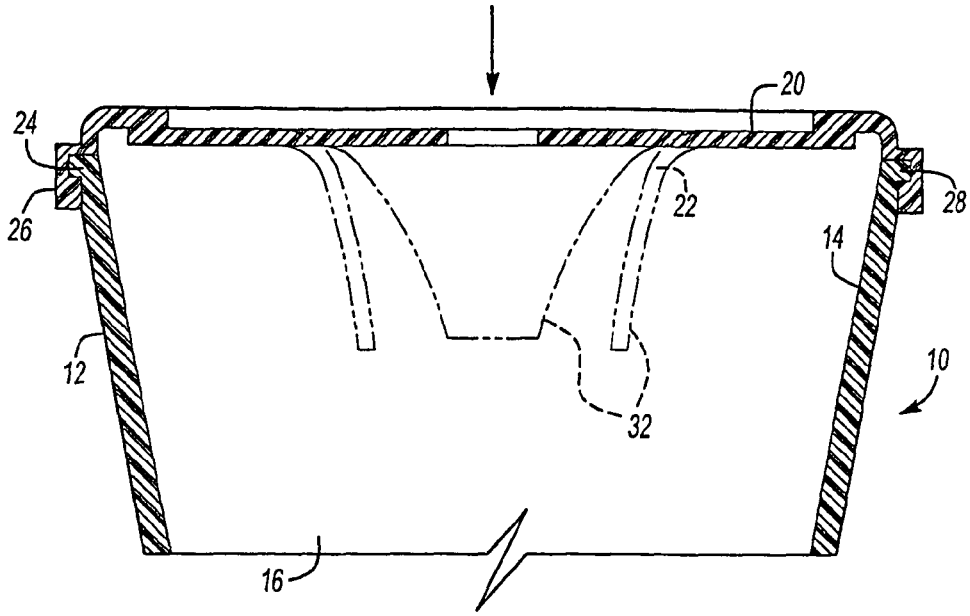
FIG. 3 is a sectional view taken substantially along line 3-3 and enlarged for clarity.

With reference to FIGS. 1-3, a preferred embodiment of a food container assembly 10 for small items, such as snack food, of the present invention is illustrated and includes a container 12. Container 12 is generally cylindrical in shape and defines an inner chamber 16 having an open top 14. Open top 14 is illustrated in the drawing as generally circular in shape, although container 12 as well as its open top may be of any desired conventional shape.

Furthermore, interior chamber 16 of container 12 is adapted to contain solid food 18 (FIG. 1), such as cereal or small items. Container 12 is preferably made of an unbreakable material, such as plastic, and may be either opaque or transparent.

Food container assembly 10 includes a lid 20 which is detachably secured to an upper rim of container 12. Lid 20, furthermore, includes a flexible portion or diaphragm 22 which extends across and covers open top 14 of container 12 when lid 20 is attached to container 12.

With reference now particularly to FIG. 3, although any conventional means may be utilized to detachably secure lid 22 to container 12, preferably container 12 includes an outwardly projecting lip 24 around its open top 14. Lid 20 is constructed with an annular flange 26, of a resilient material, that extends around the outer periphery of lid 20 and may be formed integrally with flexible portion or diaphragm 22 or as two separate components. Annular flange 26 includes an annular recess 28 designed to receive the outwardly projecting lip 24 on container 12. Thus, lid 22 is detachably secured to the container 12 by snapping flange 26 over container lip 24. In doing so, lid 20 is attached to container 12 in a sufficiently secure fashion to prevent its removal by a young child. However, an adult is able to remove lid 20 from container 12 by stretching flange 26 of lid 20 upwardly and outwardly from container lip 24 thus freeing lid 20 from container 12.

Alternatively, any conventional means, such as a screw top, can be used to detachably secure lid 22 to container 12.

Flexible portion or diaphragm 22 of lid 20 is constructed of a flexible material that will not scratch or otherwise injure a hand 34 inserted through flexible portion or diaphragm 22 and into inner chamber 16 of container 12. Also, the flexible material will not catch hand 34 causing difficulty in extricating it. Additionally, the lid portion 22 is preferably constructed of a transparent material and may be of a one-piece construction with the remainder of the lid 20.

To fulfill these objects of the invention, flexible portion or diaphragm 22 is formed of a material with a durometer of 65-95, using standard test method ASTM D 2240, and a tear strength of greater than 200 lb/in, using standard test method ASTM D-1044. Further, in the preferred embodiment, the material has a melting point greater than 220 degrees F. Materials that meet these qualifications are, for example, thermoplastic polyurethane (TPU) or thermoplastic polyesters (TPE), as well as polyolefin Elastomers (POE). Examples of commercially available materials that meet the criteria are Engage, Sarlink, Texin, Desmopan, Dynaflex, Versalloy, Versaflex, and Elastolan. It should be noted that some or all of the above commercially available materials may be trademarks of the companies manufacturing and/or selling the materials.

Referring again to FIGS. 1-3, flexible portion or diaphragm 22 includes at least one, and preferably two or more slits 30 formed through flexible portion or diaphragm 22 so that slits 30 extend generally diametrically across flexible portion or diaphragm 22. Slits 30 thus form at least one, and preferably several flaps 32 in flexible portion or diaphragm 22.

As best shown in FIGS. 1 and 3, flaps 32 are deflected inwardly as shown in phantom line in FIG. 3 upon insertion of a hand 34 into interior chamber 16 of the container 12. Because of the specific characteristics of the material forming flaps 32, one does not injure themselves by inserting their hand through flaps 32. The points of the flaps are very "soft" so that they do not scratch or otherwise engage the surface of hand 34 but flaps 32 are sufficiently strong and resilient so that they return to their original form and position after hand 34 is removed.

The specific material forming flexible portion or diaphragm 22 has shape memory so that even though it is deformed and soft enough to not injure hand 34 it returns to its original shape and position. As such, although the flaps may be deflected outwardly as shown in phantom line in FIG. 2, because of their shape memory upon removal of the child's hand 34 from the interior of container 12, flaps 32 return to their original position as shown in solid line in FIG. 3 in which flaps 32 cover open top 14 of container 12. The shape memory of the plastic material thus ensures that flaps 32 will return to their original position despite multiple deflections of flaps 32 by one inserting their hand through flap 32.

Figure 4:
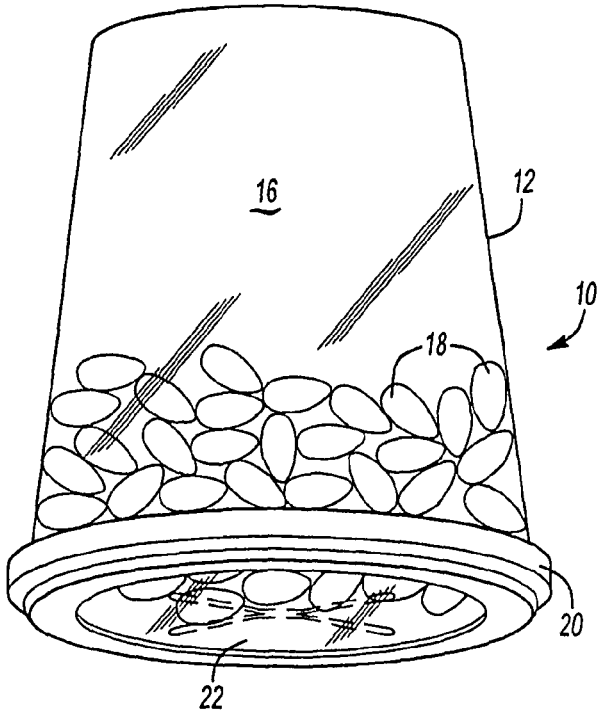
FIG. 4 is a view similar to FIG. 1 but illustrating the container in an inverted position.

In practice, with lid 20 removed from container 12, interior chamber 16 of container 12 is at least partially filled with dry, solid food or small items 18. Thereafter, lid 20 is attached to container 12 so that flexible portion or diaphragm 22 extends across and substantially covers open top 14 of container 12. In doing so, flexible portion or diaphragm 22 retains solid food or small items 18 within interior chamber 16 of container 12 even when container 12 is inverted to a position shown, for example, in FIG. 4.

Flexible portion or diaphragm 22, however, enables one to gain access through lid 20 as shown in FIG. 1 so that hand 34 can remove food 18 from the interior of the container 12 without scratching or otherwise injuring hand 34 and without catching hand 34 so as to make withdrawal difficult. However, once hand 34 is removed from container 12, flaps 32 return to their original position covering open top 14 of container 12 in the previously described fashion.

Although container assembly 10 of the present invention has been described as an anti-spill container for a child's snack food, it will be understood that container assembly 10 has many other uses. For example, container assembly 10 could also be used as a coin change container assembly for use by an adult in an automobile or elsewhere. Indeed, the anti-spill container assembly can be used in a virtually unlimited number of different applications.

From the foregoing, it can be seen that the present invention provides a simple and yet completely effective anti-spill food or small item container. Further, the lid is constructed so that no injuries occur during use and insertion and withdrawal of a hand into the inner chamber of the container is easy and unhindered. Also, because of the novel construction and material used, the assembly is relatively simple and inexpensive to manufacture.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. An anti-spill container assembly comprising:

a container having an open top and defining an interior chamber adapted to contain food or small items;

a lid detachably connected to the container, the lid including a flexible portion extending across and covering the open top of the container, the flexible portion being constructed of a material with a durometer of 65-95 and a tear strength of greater than 200 lb/in; and the flexible portion of the lid including at least one slit that forms at least one flap in the flexible portion to permit access to the interior chamber in the container.

2. The anti-spill container assembly as defined in claim 1 wherein the flexible portion of the lid is constructed of a material having a melting point greater than 220 degrees F.

3. The anti-spill container assembly as defined in claim 2 wherein the material forming the flexible portion of the lid includes one of thermoplastic polyurethane (TPU), thermoplastic polyesters (TPE), and polyolefin Elastomers (POE).

4. The anti-spill container assembly as defined in claim 1 wherein the at least one slit comprises at least two crossing linear slits thus forming at least four flaps.

5. The anti-spill container assembly as defined in claim 4 wherein the flexible portion of the lid is circular in shape and wherein the slits extend diametrically.

6. The anti-spill container assembly as defined in claim 1 wherein the flexible portion of the lid is constructed of a transparent material.

7. The anti-spill container assembly as defined in claim 1 wherein the lid includes an annular flange constructed to engage the container.

8. The anti-spill container assembly as defined in claim 7 wherein the annular flange and the flexible portion are formed in two parts.

9. The anti-spill container assembly as defined in claim 7 wherein the annular flange of the lid includes an annular recess and the container includes an outwardly projecting lip adjacent and surrounding the open top, the annular recess being designed to receive the outwardly projecting lip therein to removably secure the lid to the container.

10. An anti-spill container assembly comprising:

a container having an open top and defining an interior chamber adapted to contain food or small items;

a lid detachably connected to the container, the lid including a flexible portion extending across and covering the open top of the container, the flexible portion being constructed of a material with a durometer of 65-95 and a tear strength of greater than 200 lb/in; and the flexible portion of the lid including at least a plurality of diametrically extending slits forming a plurality of flaps in the flexible portion to permit access to the interior chamber in the container, the flaps being sufficiently soft to allow insertion and withdrawal of a hand into the interior chamber without injury or obstruction.

11. The anti-spill container assembly as defined in claim 10 wherein the flexible portion of the lid is constructed of a material having a melting point greater than 220 degrees F.

12. The anti-spill container assembly as defined in claim 11 wherein the material forming the flexible portion of the lid includes one of thermoplastic polyurethane (TPU), thermoplastic polyesters (TPE), and polyolefin Elastomers (POE).

13. The anti-spill container assembly as defined in claim 10 wherein the flexible portion of the lid is constructed of a transparent material.

14. The anti-spill container assembly as defined in claim 10 wherein the lid includes an annular flange constructed to engage the container.

15. The anti-spill container assembly as defined in claim 14 wherein the annular flange and the flexible portion are formed in two parts.

16. The anti-spill container assembly as defined in claim 14 wherein the annular flange of the lid includes an annular recess and the container includes an outwardly projecting lip adjacent and surrounding the open top, the annular recess being designed to receive the outwardly projecting lip therein to removably secure the lid to the container.

17. An anti-spill container assembly comprising:

a container having an open top and defining an interior chamber adapted to contain food or small items;

a lid detachably connected to the container, the lid including a flexible portion extending across and covering the open top of the container and an annular flange surrounding the open top and removably engaging an outer surface of the container;

the flexible portion of the lid being constructed of a material including one of thermoplastic polyurethane (TPU), thermoplastic polyesters (TPE), and polyolefin Elastomers (POE); and the flexible portion of the lid including at least a plurality of diametrically extending slits forming a plurality of flaps in the flexible portion to permit access to the interior chamber in the container, the flaps being sufficiently soft to allow insertion and withdrawal of a hand into the interior chamber without injury or obstruction.

18. The anti-spill container assembly as defined in claim 17 wherein the annular flange and the flexible portion are formed in two parts.

19. The anti-spill container assembly as defined in claim 17 wherein the annular flange of the lid includes an annular recess and the container includes an outwardly projecting lip adjacent and surrounding the open top, the annular recess being designed to receive the outwardly projecting lip therein to removably secure the lid to the container.

20. The invention as defined in claim 17 wherein the flexible portion of the lid is constructed of a material having a melting point greater than 220 degrees F.

* * * * *